US007770362B2

(12) United States Patent
Koehn

(10) Patent No.: US 7,770,362 B2
(45) Date of Patent: Aug. 10, 2010

(54) METHOD AND DEVICE FOR PRODUCING AND FILLING SACKS

(75) Inventor: Uwe Koehn, Osnarbueck (DE)

(73) Assignee: Windmoeller & Hoelscher KG, Lengerich (DE)

( * ) Notice: Subject to any disclaimer, the term of this patent is extended or adjusted under 35 U.S.C. 154(b) by 75 days.

(21) Appl. No.: 11/628,653

(22) PCT Filed: Jun. 30, 2005

(86) PCT No.: PCT/EP2005/007157

§ 371 (c)(1),
(2), (4) Date: Dec. 6, 2006

(87) PCT Pub. No.: WO2006/007960

PCT Pub. Date: Jan. 26, 2006

(65) Prior Publication Data

US 2007/0289262 A1 Dec. 20, 2007

(30) Foreign Application Priority Data

Jul. 16, 2004 (DE) ..... 10 2004 034 489

(51) Int. Cl.
*B65B 43/04* (2006.01)
*B65B 51/26* (2006.01)
*B31B 19/74* (2006.01)

(52) U.S. Cl. ..... 53/459; 53/469; 53/567; 53/570; 53/284.7; 493/190; 493/196; 493/201

(58) Field of Classification Search ..... 53/459, 53/450, 451, 567, 550, 551, 370.2, 370.7, 53/372.3, 373.7, 375.3, 469, 570, 284.7; 493/189, 190, 193–196, 199–201, 203
See application file for complete search history.

(56) References Cited

U.S. PATENT DOCUMENTS

| | | | | |
|---|---|---|---|---|
| 3,201,914 | A | 8/1965 | Lohse et al. | |
| 3,462,067 | A * | 8/1969 | Shore | 383/104 |
| 3,739,977 | A * | 6/1973 | Shapiro et al. | 493/189 |
| 3,915,077 | A * | 10/1975 | LaFleur et al. | 493/194 |
| 4,353,196 | A * | 10/1982 | Beer et al. | 53/451 |
| 4,510,736 | A | 4/1985 | Müeller | |
| 4,557,377 | A * | 12/1985 | Maloney | 206/219 |
| 4,835,948 | A * | 6/1989 | Humphrey | 53/567 |
| 4,873,815 | A * | 10/1989 | Tetenborg et al. | 53/570 |
| 5,448,879 | A * | 9/1995 | Concetti | 53/567 |
| 5,758,473 | A * | 6/1998 | Patelli | 53/412 |
| 5,944,251 | A * | 8/1999 | LaFleur | 229/117.35 |
| 5,984,850 | A * | 11/1999 | Derby | 493/29 |

(Continued)

FOREIGN PATENT DOCUMENTS

CA 2077295 3/1993

(Continued)

*Primary Examiner*—Stephen F Gerrity
(74) *Attorney, Agent, or Firm*—Jacobson Holman PLLC

(57) ABSTRACT

A method and a device for producing and filling sacks with at least four longitudinal seams provide a more cost-effective approach to producing and filling sacks. The material that forms the sacks is supplied from an unwinding device in the form of a tubular material to a sack forming device. The tubular material is provided with longitudinal seams in the sack forming device, with the seams extending over a major part of the sacks.

14 Claims, 2 Drawing Sheets

U.S. PATENT DOCUMENTS

| | | | | |
|---|---|---|---|---|
| 6,003,289 | A * | 12/1999 | McGregor et al. | 53/570 |
| 6,374,579 | B1 * | 4/2002 | Muller | 493/189 |
| 6,401,439 | B1 | 6/2002 | Tetenborg et al. | |
| 6,428,456 | B1 | 8/2002 | Visona' et al. | |
| 6,460,317 | B1 | 10/2002 | Voss | |
| 2004/0013325 | A1 | 1/2004 | Cook | |
| 2006/0030470 | A1 * | 2/2006 | Voss et al. | 493/194 |

FOREIGN PATENT DOCUMENTS

| | | | |
|---|---|---|---|
| DE | 35 14714 | A1 | 10/1986 |
| DE | 44 23 964 | C1 | 12/1995 |
| DE | 196 03 371 | A1 | 8/1997 |
| DE | 199 20 478 | A1 | 11/2000 |
| DE | 199 33 486 | A1 | 11/2000 |
| DE | 199 36 660 | A1 | 11/2000 |
| EP | 0 534 062 | A1 | 3/1993 |

* cited by examiner

METHOD AND DEVICE FOR PRODUCING AND FILLING SACKS

CROSS-REFERENCE TO RELATED APPLICATION

This is a nationalization of PCT/EP2005/007157 filed 30 Jun. 2005 and published in German.

BACKGROUND OF THE INVENTION

1. Field of Invention

The invention relates to a method and device for producing and filling sacks. The material that forms the sacks is supplied in the form of a tubular material from an unwinding device to a sack-forming device. The tubular material is separated into individual tube pieces in the sack-forming device and the tube pieces are transported by grippers during at least one part of their path in the sack-forming device.

2. Description of the Prior Art

Sacks are produced inter alia by so-called "Form, Fill and Seal" machines (referred to as FFS machines in the following).

These machines, which are shown inter alia in the patent specifications DE 199 33 486, EP 534 062, DE 44 23 964, DE 199 20 478 and DE 199 36 660, have unwinding devices, on which tubes are stored. The tube is unwound by these unwinding devices and separated into tube pieces. Usually, tube bottoms are formed, filling material is filled in the resulting sack and the sack is sealed in the additional work steps. The type of sack formation and filling shown in the afore-mentioned documents forms a part of the contents disclosed in this document. The same applies to the definitions of the term "Form, Fill and Seal" machines (FFS) provided in these documents and also to the transport of the film tubes, film sections and sacks into these machines. Usually bulk materials are filled using these machines.

As a rule, for the purpose of processing on the FFS machines, film tubes are formed by blown film extrusion, the format of the film tubes (here their circumference) corresponding to that of the formed sack. However, as a result of this approach, it is necessary to carry out expensive format changes at the extrusion systems with relative frequency in order to be able to realize different sack formats. Furthermore, the formats required for the sack formation, are relatively small and can be produced in a relatively uneconomic manner. Blown film extrusion systems of a larger format produce the same film at lower costs per unit of area.

Therefore, many a time attempts are made to produce initially very broad film webs by flat film extrusion or by blown film extrusion on systems of a large format, wherein usually blown film extrusion systems were preferred likewise primarily for reasons of economy. The resulting film tubes or film webs of large format were then processed further into flat film webs by cutting them in accordance with the format.

Subsequently, one of these laid flat film webs was folded together into a tube and joined by a longitudinal weld seam to form a tube. However, the use of the machines described is primarily limited to industrial applications, such as the bagging of dyes, plastic granulate, fertilizers and other bulk materials.

Consumer goods sold by retail are usually transported and distributed in sacks of a higher quality. It is thus known, for example, to produce side-gusseted bags or side-gusseted sacks from tube pieces, which are formed from several film sections. The edges of the respective film sections are usually heat-sealed to one another for this purpose. This procedure is carried out between welding jaws, which arrest the material to be heat-sealed during the welding process.

Tube pieces are usually produced in this way, the length of which corresponds to that of the sacks formed subsequently. In other cases, directly after production, the tube pieces formed are provided with the length of the sack formed subsequently and supplied individually to the sack-forming and filling devices. This type of forming high-quality sacks is well known, for example, in the field of pet foods. Here, emphasis is laid on side-gusseted sacks, which have edge seams on each of their outer folds. These sacks are rumored to have greater stability and a better appearance, in particular. These sacks are usually produced by initially producing a tube by the longitudinal welding of a flat film. This tube is separated into individual tube pieces and is provided with additional longitudinal weld seams.

However, both the transport of the individual tube pieces and the subsequent introduction of the latter into a sack-forming and filling process are complex. This usually takes place using rotary feeders or other suction devices, which grasp the tube pieces individually and supply them to the sack-forming device. Such suction devices are expensive and prone to faults.

SUMMARY OF THE INVENTION

It is therefore the object of the present invention to provide a more cost-effective method for producing and filling sacks as described herein.

This object is achieved

- by supplying the material that forms the sacks in the form of a tubular material from an unwinding device to a sack-forming device, and
- by providing the tubular material in the sack-forming device with longitudinal seams, which extend at least over a large part of the sacks.

The term "seams" or "longitudinal seams" in this context is meant to connote a generic term for joining seams and all other seams, which also include the edge seams. It is not the function of the edge seams, in particular, to hold together the joining points of flat films like joining seams. The function of the edge seams consists in the described stabilization of the sack, which supports particularly the formation of an approximately cuboid shape in its filled state and thus facilitates the stacking of such sacks.

In order to now process the tubular material into sacks, it is advantageous to initially form sack bottoms using transverse welds. Transverse welds can be formed with particular ease on the material that is still tubular since this material can be grasped at different points by grippers or pliers or similar holding means.

For the same reason, it is recommended to also form longitudinal seams before the material is separated into individual tube pieces. The formation of the longitudinal seams can precede the formation of the transverse weld seams. In addition, the tubular material can be provided before or after the formation of the longitudinal seams, with diagonal welds, which form so-called corner welds on the sacks formed subsequently. Said corner welds further increase the stability of the sacks.

In an advantageous improved development of the invention, the sacks are also filled in the sack-forming device. A tube piece, which is held using holding means for the purpose of forming longitudinal seams or transverse seams, can be supplied by the same or additional holding means to a filling device. The time-consuming processes of depositing, storing and again gathering the tube pieces are thus omitted. Holding means designed advantageously as grippers carry out the transportation through the sack-forming device. The grippers can be present in pairs in each case, wherein they engage around the tube pieces laterally in the region of the upper edge. It may be necessary to deliver the tube piece from one pair of grippers to another. For this purpose, transfer positions are provided at which both the pairs of grippers hold the tube piece temporarily. The transport of the tube pieces or the sacks takes place in the horizontal direction at least for the first half of their path, i.e. in every movement of the tube pieces or the sacks the horizontal distance exceeds the vertical distance.

In the sack-forming device, the tubular material can be provided with longitudinal seams during the stop phases of the intermittent transport. Basically, longitudinal seams can also be applied during the transport of the tubular material. However, in the previous case, the longitudinal seams can be formed over different periods of time, which are indeed limited upwards by the reciprocal cycle speed, but are variable in other respects. If the longitudinal seams are formed, for example, using welds, then the weld time can be selected, for example, as a function of the material thickness.

BRIEF DESCRIPTION OF THE DRAWINGS

Additional exemplary embodiments of the invention are specified in the present description and the claims. The figures underlying the present description show:

DETAILED DESCRIPTION OF THE PREFERRED EMBODIMENTS

Figure 1:
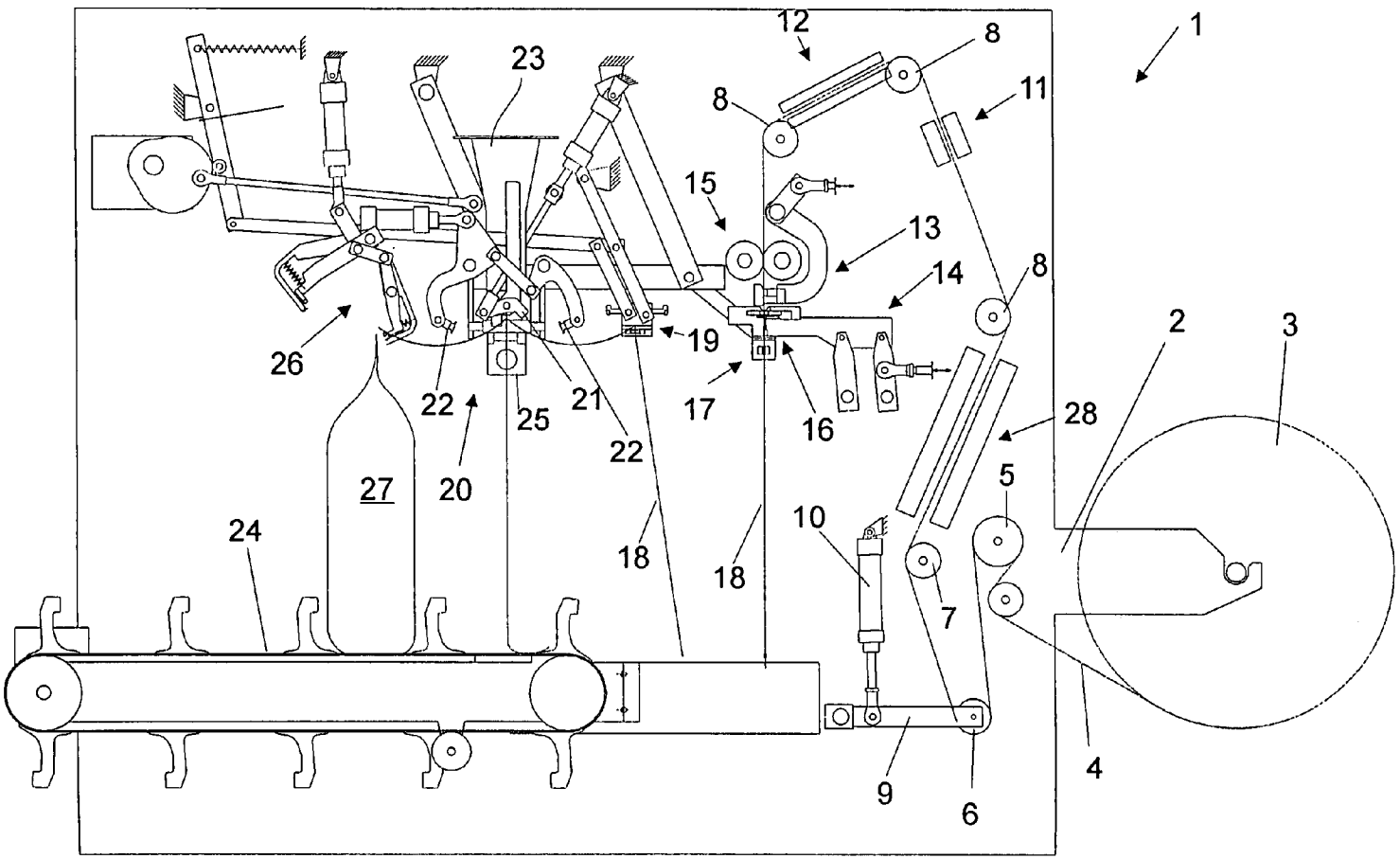
FIG. 1: a device for producing and filling sacks, with which device the method according to the invention can be performed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

This device 1 comprises a supporting arm 2, on which lies a roll 3 of tubular film 4. The tubular film 4 has side gussets that are not illustrated. The transport rollers 5, which can also be driven partially, ensure a usually continuous unwinding of the tubular film 4. The lever 9, which is provided with a load by a piston-cylinder unit 10 and which carries a deflecting roller 6 and is frequently referred to as dancer device when taken as a whole, and the transport roller 7, 8 and the pair of feed rollers 15 altogether ensure in a manner known per se that the tubular film 4 is moved further on its route of transport in a cyclically intermittent manner. In its further course, the tubular film 4 passes through a station 28 for applying longitudinal seams. Longitudinal seams are applied to the outer edges of the side gussets of the tubular film 4 in a manner that is not illustrated in detail, the working length of the station 28 being at least of the length of the sacks formed subsequently. The longitudinal seams are usually produced by applying the welds during the stop phases of the intermittent transport. The tubular film 4 provided with longitudinal seams is conveyed using additional transport rollers 8 to a corner weld station 11 and a cooling station 12.

Using the pair of feed rollers 15, the tubular film 4 is pushed through the welding jaws of a cross welding station 13 and through a cross cutting station 16. The tools of the cross welding station 13 and the cross cutting station 16 can be moved toward and away from the tubular film 4 in a manner that is not described in detail here, for example, using a parallelogram arrangement 14, in planes that are orthogonal to the feed direction of the tubular film 4. After the grippers 17 have grasped the tubular film 4, a tube piece 18 is cut off in the cross cutting station 16 from the tubular film 4 above the grippers 17. Simultaneously, in the cross welding station 13, a cross weld is added to the tubular film above its cut edge. This cross weld represents the bottom of the tube piece 18 to be formed in the next work cycle of the device 1. The cross-weld is the preferred, though not the only option for creating the bottoms. Additional joining techniques, such as for example, gluing are also feasible.

The grippers 17 convey the tube piece 18 to a transfer point at which additional grippers 19 grasp the tube piece 18 and transport it to a filling station 20. There the tube piece 18 is transferred to stationary grippers 21 and opened by the suction devices 22 so as to enable the filling material which is led by the filling pipe 23 to enter into the tube piece 18. In doing so, the tube piece 18 lies with its lower end on a conveyor belt 24 so as to prevent it 18 from being loaded excessively along its longitudinal edges during the filling process. Additional grippers 25 convey the filled tube piece to the head seam welding station 26 in which the tube piece 18 is sealed with a head weld seam and it thus forms a finished sack 27. It is also possible to use other joining techniques to seal the head region of the tube piece 18. The finished sack is guided out of the device 1 by the conveyor belt 24.

Figure 2:
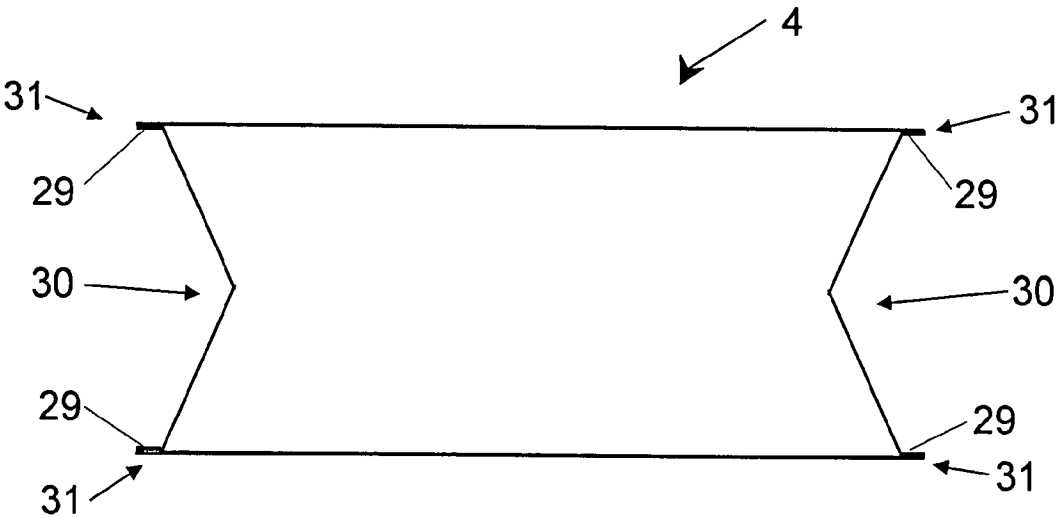
FIG. 2: a cross-section of a tubular material, which was provided with longitudinal seams according to the inventive method.
Figure 3:
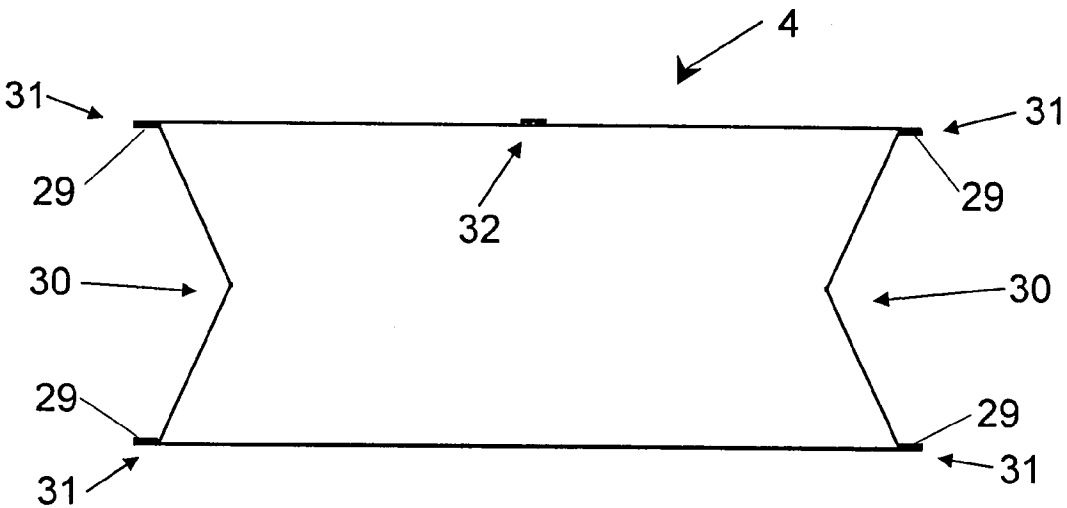
FIG. 3: a cross-section of another tubular material, which was provided with longitudinal seams according to the inventive method.

FIGS. 2 and 3 show cross-sections of tubular materials 4, which were provided with longitudinal seams according to the inventive method. The material 4 shown in FIG. 2 is usually produced as a tubular film and is wound up into a roll 3 after being provided with side gussets 30. The tubular material 4 is provided with edge seams 29 on its outer edges 31 in the station 28 for the application of longitudinal seams. The tubular material 4 shown in FIG. 3 differs from that 4 shown in FIG. 2 in terms of a longitudinal seam 32, with which both the edge regions of a flat film are joined to one another for the purpose of forming a tube. As a rule, this joining process is carried out by heat-sealing. However, other joining techniques such as sealing or the application of adhesives or hot melt adhesives are also used in practice. After such a formation of a tubular material 4, which can likewise be provided with side gussets 30, the tubular material 4 is wound up into a roll.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

LIST OF REFERENCE SYMBOLS

1 Device for producing and filling sacks
2 Supporting arm
3 Roll
4 Film
5 Transport roller
6 Deflecting roller

7 Transport roller
8 Transport roller
9 Lever
10 Piston-cylinder unit
11 Corner weld station
12 Cooling station
13 Cross-welding station
14 Parallelogram arrangement
15 Pair of feed rollers
16 Cross-cutting station
17 Gripper
18 Tube piece
19 Gripper
20 Filling station
21 Stationary gripper
22 Suction device
23 Filling pipe
24 Conveyor belt
25 Gripper
26 Head seam welding station
27 Sack
28 Station for applying longitudinal seams
29 Edge seams
30 Side gussets
31 Outer edges
32 Longitudinal seam

What is claimed is:

1. A method for producing and filling sacks comprising:

supplying a material that forms the sacks in a form of a tubular material from an unwinding device to a sack-forming device, the tubular material being supplied in a cyclically intermittent transport mode;

providing the tubular material in the sack-forming device with at least four longitudinal seams while the tubular material is in a laid-flat state, the longitudinal seams extending at least over a major part of a sack length, the step of providing the longitudinal seams including applying a weld during a stopped phase of the intermittent transport;

cooling the longitudinal seams of the tubular material in a cooling device;

separating the cooled, seamed tubular material into individual tube pieces; and transporting the tube pieces by grippers during at least one part of a path in the sack-forming device.

2. The method according to claim 1, wherein the sack-forming device forms the sacks by forming sack bottoms in the tubular material by cross-welds.

3. The method according to claim 1, wherein the sack-forming device fills the sacks with filling material.

4. The method according to the claim 1, wherein the grippers engage around the tube pieces in an outer edge region thereof with the tube piece hanging down.

5. The method according to claim 1, wherein the tube pieces are transported horizontally for at least one half of the path.

6. The method according to claim 1, further comprising, before the step of supplying the tubular material from the unwinding device, a step of joining edge regions of a flat film to each other with a longitudinal joining seam so as to provide the tubular material.

7. The method according to claim 1, wherein the tubular material is a side-gusseted tube and the longitudinal seams are applied on outer folds of the side-gusseted tube.

8. The method according to claim 1, wherein the tubular material is provided with diagonal welds.

9. A device for manufacturing and filling sacks comprising:

an unwinding device from which a material that forms the sacks is supplied as a tubular material to a sack-forming device, the tubular material being supplied in a cyclically intermittent transport mode;

a longitudinal weld device that provides the tubular material in the sack-forming device with at least four longitudinal seams which extend over at least a major part of a sack length while the tubular material is in a laid-flat state, the longitudinal weld device being configured to apply a weld during a stopped phase of the intermittent transport;

a cooling device that cools the longitudinal seams of the tubular material;

a cross-cutting station in which the tubular material is separated into tube pieces; and holding means for transporting the tube pieces during at least one part of their path in the sack-forming device.

10. The device according to the claim 9, further comprising a dancer device provided between the unwinding device and the longitudinal weld device.

11. The device according to claim 9, wherein the cooling device has a length of at least 30 cm in a transport direction of the tubular material.

12. The device according to claim 9, wherein the cooling device has a length of at least 45 cm in a transport direction of the tubular material.

13. A method of producing and filling a sack comprising:

supplying a tubular material laid in a flat state from an unwinding device to a sack-forming device, the tubular material including a first and a second gusset at opposed sides of the tubular material, and the tubular material being supplied in a cyclically intermittent transport mode;

providing the unwound flat tubular material in the sack-forming device with at least four longitudinal seams which extend over at least a major part of a sack length, each of the seams being located along a sack edge, the step of providing the longitudinal seams including applying a weld during a stopped phase of the intermittent transport;

cooling the longitudinal seams of the tubular material in a cooling device;

separating the cooled, seamed tubular material into individual tube pieces; and transporting the tube piece by grippers.

14. The method according to claim 13, wherein the longitudinal seam is a welded seam that stabilizes the sack.

* * * * *